US011178957B2

(12) United States Patent
Steele

(10) Patent No.: US 11,178,957 B2
(45) Date of Patent: Nov. 23, 2021

(54) INTEGRATED MODULAR BACKPACK AND UTILITY FRAME PLATFORM AND ELECTRONICS SUB SYSTEM

(71) Applicant: Steele Industries, LLC, Denver, CO (US)

(72) Inventor: Nathan Alan Steele, Denver, CO (US)

(73) Assignee: Steele Industries II, LLC, Simla, CO (US)

( * ) Notice: Subject to any disclaimer, the term of this patent is extended or adjusted under 35 U.S.C. 154(b) by 0 days.

(21) Appl. No.: 16/460,324

(22) Filed: Jul. 2, 2019

(65) Prior Publication Data

US 2020/0000209 A1 Jan. 2, 2020

Related U.S. Application Data

(60) Provisional application No. 62/693,159, filed on Jul. 2, 2018.

(51) Int. Cl.

| | |
|---|---|
| ***A45F 3/08*** | (2006.01) |
| *F41H 5/06* | (2006.01) |
| *A45F 3/00* | (2006.01) |

(52) U.S. Cl.

CPC ..... *A45F 3/08* (2013.01); *A45F 2003/003* (2013.01); *F41H 5/06* (2013.01)

(58) Field of Classification Search

CPC ..... A45F 3/08; A45F 2003/003; F41H 5/06

USPC ..... 224/576

See application file for complete search history.

(56) References Cited

U.S. PATENT DOCUMENTS 3,881,644 A * 5/1975 Demaline ..... A47D 13/025 224/153
3,923,217 A * 12/1975 Dean, II ..... A45F 4/04 224/154
3,998,476 A * 12/1976 Kazmark, Sr. ..... B62B 1/125 280/655
4,248,367 A * 2/1981 Buel ..... A45F 4/02 224/153
4,433,802 A * 2/1984 Woolf ..... B62J 7/04 224/153
4,593,841 A * 6/1986 Lange ..... A45C 9/00 224/153
5,161,811 A * 11/1992 Cheng ..... B62B 1/125 280/30
5,374,073 A * 12/1994 Hung-Hsin ..... A45C 5/14 16/113.1
5,507,508 A * 4/1996 Liang ..... A45C 5/14 190/18 A
5,515,576 A * 5/1996 Tsai ..... A45C 13/262 16/113.1
5,639,109 A * 6/1997 Liang ..... A45C 13/262 16/113.1
5,660,476 A * 8/1997 DeCoster ..... A45C 11/20 190/108

(Continued)

*Primary Examiner* — Peter N Helvey
(74) *Attorney, Agent, or Firm* — Merchant & Gould P.C.

(57) ABSTRACT

A backpack includes a frame system. The frame system has two L-shaped members, one or more cross bars, and an attachment bar. A pack has a base, a rear wall, a front wall, two side walls, and a closable lid. The pack also has shoulder straps disposed at the rear wall and a pair of elongated channels on the rear wall. The pack removably couples to the frame system by inserting a long leg of each of the L-shaped members into the respective elongated channel. When the pack is coupled to the frame, the base of the pack is supported on two short legs of the L-shaped members, the frame system is on an exterior of the pack, and the attachment bar can removably couple to either end of the two L-shaped members. An insert is sized and shaped to be removably inserted within an interior volume of the pack.

14 Claims, 13 Drawing Sheets

(56) References Cited

U.S. PATENT DOCUMENTS

| | | | | | |
|---|---|---|---|---|---|
| 5,829,558 | A * | 11/1998 | Cheng | A45C 13/262 | 190/116 |
| 6,390,345 | B1 * | 5/2002 | Brown | A45C 3/00 | 190/110 |
| 6,561,395 | B2 * | 5/2003 | Lim | A45C 5/14 | 190/103 |
| 7,021,508 | B1 * | 4/2006 | Aston | A45F 3/00 | 224/628 |
| 7,143,912 | B2 * | 12/2006 | Caneba | A45C 13/262 | 224/153 |
| 7,946,609 | B2 * | 5/2011 | Johnson | A45C 13/28 | 280/652 |
| 8,641,056 | B1 * | 2/2014 | Carter | B62B 1/12 | 280/30 |
| 2002/0043544 | A1 * | 4/2002 | Caneba | A45C 13/262 | 224/584 |
| 2006/0208024 | A1 * | 9/2006 | Gleason, Jr. | A45F 3/08 | 224/633 |
| 2008/0061093 | A1 * | 3/2008 | Pottharst | A45C 15/00 | 224/155 |
| 2010/0294820 | A1 * | 11/2010 | Neibarger | A45F 3/00 | 224/576 |
| 2012/0018477 | A1 * | 1/2012 | Inouye | A45F 3/06 | 224/576 |
| 2014/0124561 | A1 * | 5/2014 | Neibarger | F41H 1/02 | 224/625 |
| 2016/0100673 | A1 * | 4/2016 | Demskey | A45C 13/36 | 224/576 |
| 2016/0374458 | A1 * | 12/2016 | Jansen | A45F 3/04 | 224/576 |

* cited by examiner

INTEGRATED MODULAR BACKPACK AND UTILITY FRAME PLATFORM AND ELECTRONICS SUB SYSTEM

CROSS-REFERENCE TO RELATED APPLICATIONS

This application claims priority to and the benefit of U.S. Provisional Application No. 62/693,159, filed Jul. 2, 2018, tilted "INTEGRATED MODULAR BACKPACK AND UTILITY FRAME PLATFORM AND ELECTRONICS SUB SYSTEM," the disclosure of which is hereby incorporated by reference herein in its entirety for all that it teaches and for all purposes.

INTRODUCTION

Backpacks are commonly used for carrying loads with straps that go over the shoulders. Some backpacks are specifically designed for carrying specialized loads such as water bladders or camping equipment. First responders, for example, police, military, medical, search and rescue, etc., however, are often required to carry specialized loads that quickly change. As such, some backpacks require the ability to quickly and easily reconfigure and adapt as the user's needs change.

SUMMARY

In one aspect, the technology relates to a backpack including: a frame system including: two substantially L-shaped members, each L-shaped member having a short leg and a long leg; one or more cross bars that extend between the two L-shaped members; and at least one attachment bar that removably couples to either end of the two L-shaped members and extends therebetween; a pack including: a base; a rear wall, a front wall, and two side walls, wherein the walls extend from the base; a closable lid, wherein an interior volume is defined by the base, the walls, and the lid; at least one shoulder strap disposed at the rear wall; and a pair of elongated channels spaced apart on the rear wall, the pair of elongated channels extending in a direction from the base towards the lid, wherein the pack removably couples to the frame system by inserting at least a portion of each of the long legs into the respective elongated channel, and wherein when the pack is coupled to the frame, the base of the pack is supported on the two short legs of the L-shaped member, the frame system is on an exterior of the pack, and the at least one attachment bar can removably couple to either end of the two L-shaped members; and an insert sized and shaped to be removably inserted within the interior volume of the pack.

In an example, the pack is free-standing without the use of the insert or the frame system. In another example, an electronic hub is coupled to the insert and a removable power source. In yet another example, the removable power source is disposed within one or more of the components of the frame system. In still another example, the removable power source is coupled to the insert. In an example, the insert is formed from ballistic material.

In another example, the one or more cross bars are removably coupled to the two L-shaped members. In yet another example, the at least one attachment bar slidingly engages with the two L-shaped members. In still another example, the at least one attachment bar further includes at least one angled load bar and/or curved load bar.

In another aspect, the technology relates to a modular backpack system including: a pack including a base and a rear panel, wherein the rear panel includes at least one shoulder strap and two elongated channels, wherein the pack defines an internal volume and the internal volume is closeable with a lid; a frame system couplable to an exterior of the pack, wherein the frame system includes two L-shaped members each having a long leg and a short leg and the two L-shaped members are coupled together by one or more cross bars extending therebetween, wherein the pack couples to the frame system by sliding the long leg of each L-shaped member through a respective elongated channel so that the rear panel is adjacent to the long legs of the frame system and the base is adjacent to the short legs of the frame system; at least one removable attachment bar that removably couples to the two L-shaped members and extends therebetween, wherein the at least one removable attachment bar is configured to support external equipment; and an insert removably insertable within the interior volume of the pack, wherein the insert includes an open top container.

In an example, the insert has a greater rigidity than the pack. In another example, the frame system includes substantially tubular members, and at least one of the tubular members are configured to store one or more batteries therein. In yet another example, the one or more cross bars include a slotted plate. In still another example, an electronic system is coupled to the insert, the electronic system includes a power source and an electronic hub for powering external electronic components. In an example, the electronic system is coupled to an exterior of the open top container.

In another example, the electronic hub is proximate the lid of the pack, when the insert is inserted within the internal volume of the pack. In yet another example, the electronic system further includes a solar panel disposed on an exterior portion of the lid. In still another example, the frame system is configurable between a first configuration and a different second configuration, the first configuration is a chair-like shape and the second configuration is a stretcher-like shape.

In another aspect, the technology relates to a backpack including: a freestanding pack including: a base; a rear wall, a front wall, and two side walls, wherein the walls extend from the base; a closable lid that is hinged at the rear wall and selectively couples to each of the other walls, wherein the rear wall has a greater height than the front wall, and wherein an interior volume is defined by the base, the walls, and the lid; two shoulder straps disposed at the rear wall; and two elongated channels spaced apart on the rear wall and extending in a vertical direction; and a rigid external frame system including: two substantially L-shaped members spaced apart from one another by one or more removable cross bars, each L-shaped member having a long leg and a short leg, wherein when the pack is removably coupled to the frame system, the long legs are received within the elongated channels so that the rear wall is adjacent to the long legs, the base is supported on the short legs, and the long legs and the short legs extend out past an exterior of the pack; and at least one attachment bar that slidably engages the long legs or the short legs and extends therebetween.

In an example, an insert sized is and shaped to be removably inserted within the interior volume of the pack, the insert includes a power source and an electronic hub for powering external electronic components.

DRAWINGS

There are shown in the drawings, embodiments which are presently preferred, it being understood, however, that the technology is not limited to the precise arrangements and instrumentalities shown.

DETAILED DESCRIPTION

The examples of a backpack described herein provide a single modular system for carrying a variety of loads for a variety of different uses. By having a single backpack that can perform a variety of functions, separate specialized backpacks are no longer needed, thereby increasing performance for its users, such a first responders (military, medical, police, etc.). The backpack includes a pack with shoulder and waist straps. The pack can be free-standing and it is configured to carry a load within. A rigid insert is sized and shaped to be carried within the pack and the insert can support an electronic system so that any number of tools and equipment can be powered by the backpack. The insert can be customized so that specialized equipment kits can quickly and easily be switched out of the pack for different uses. By using the insert instead of the pack itself to load tools and equipment, individual components do not need to be separately taken in and out of the pack, increasing the potential of accidently misplacing equipment.

The backpack also includes a frame system that removably couples to an exterior of the pack. The frame system has a chair-like shape and forms a plurality of attachment points. The frame system is used to support externally a variety of tools, equipment, and support accessories as required or desired. By using the frame system to support external attachments, the function of the pack does not change and the frame system can be utilized for a number of independent uses without the pack. Accordingly, the modular-type system of the backpack described herein, provides a highly efficient and adaptable backpack that works well for any number of different types of uses.

As used herein, directional terms such as "front," "rear," "base," "lid," etc. are used for convenience only and are not to be considered limiting.

Figure 1:
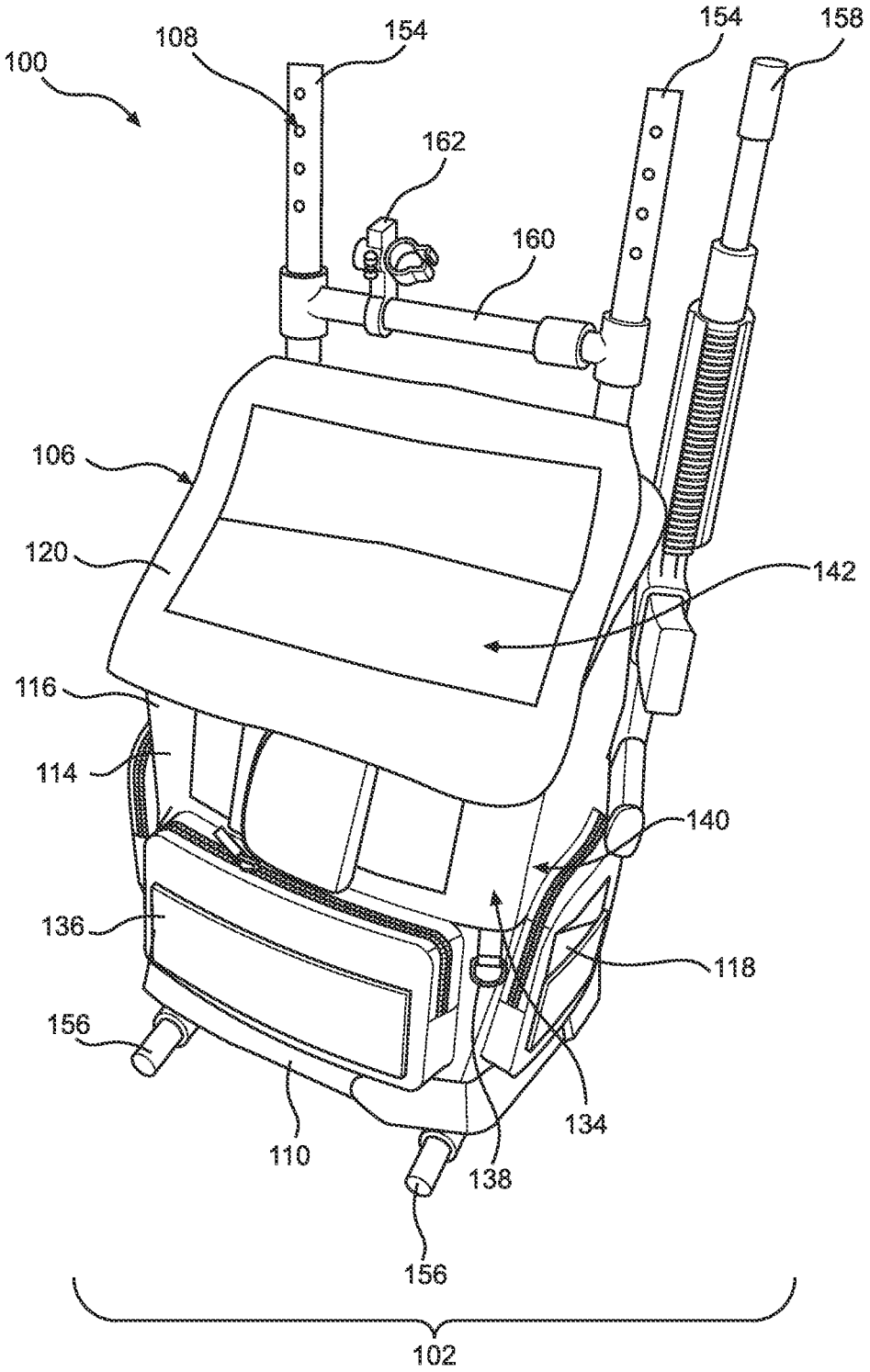
FIG. 1 is a front perspective view of an exemplary modular backpack in a first configuration.
Figure 2:
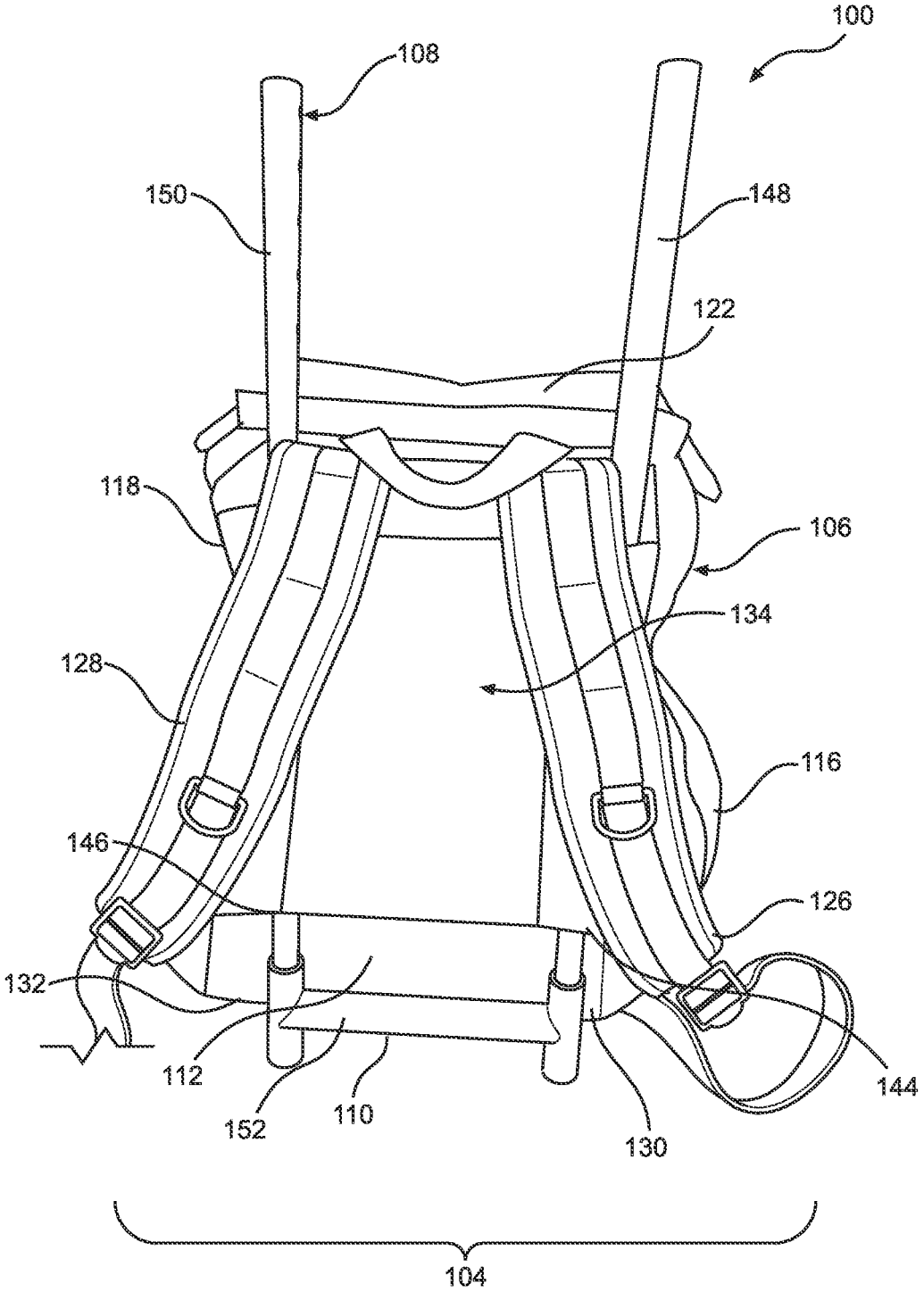
FIG. 2 is a rear perspective view of the modular backpack in a second configuration.

FIG. 1 is a front perspective view of an exemplary modular backpack 100 in a first configuration 102. FIG. 2 is a rear perspective view of the modular backpack 100 in a second configuration 104. Referring concurrently to FIGS. 1 and 2, the backpack 100 includes a pack 106 that is configured to removably couple to a frame system 108. The pack 106 includes a base 110 having a rear wall 112, a front wall 114, and left and right side walls 116, 118, all extending upwards therefrom. A closable lid 120 is attached to the top of the rear wall 112 by a hinge 122. The base 110, the walls 112-118, and the lid 120 define an interior volume 124 (shown in FIG. 4) that a load can be placed within and carried on a user's back. Left and right adjustable shoulder straps 126, 128 are disposed at the rear wall 112 and extend proximate the lid 120 to proximate the base 110. Additionally, left and right adjustable waist straps 130, 132 are disposed at the rear wall 112 adjacent the base 110. The shoulder straps 126, 128 and the waist straps 130, 132 enable a user to comfortably secure the backpack 100 and support the load carried.

The pack 106 can include any number and configuration of features on an exterior surface 134 of the pack 106 and on one or more of the walls 112-118 and/or the lid 120. The pack features can include pockets 136, D-rings 138, MOLLE (Modular Lightweight Load-carrying Equipment) systems 140, fastener areas 142 (e.g., hook and loop (VELCO), magnetic, snaps, or the like), bottle nets (not shown), etc. In some examples, one or more of the pack features can be removable for relocation on other areas of the exterior surface 134 of the pack 106 as required or desired. The pack features protrude from the exterior surface 134 so that easy access is facilitated, and so that the interior volume of the pack 106 is maintained. The fastener areas 142 may be used to externally attach a variety of tools or equipment to the backpack 100, such as speakers, nets, cup holders, tool holders, lights, solar panels, etc.

Discrete left and right elongated channels 144, 146 are disposed on either side of the rear wall 112 and spaced apart from one another. The elongated channels 144, 146 extend in a vertical direction from the base 110 towards the lid 120. Each elongated channel 144, 146 is sized and shaped to receive at least a portion of the frame system 108 so that the pack 106 can couple to the frame system 108. The frame system 108 includes left and right substantially L-shaped members 148, 150 with one or more cross bars 152 extending therebetween. Each L-shaped member 148, 150 includes a long leg 154 and a short leg 156. In the example, the long leg 154 is positioned about 90° relative to the short leg 156. In other examples, the long leg 154 may be positioned between 60° and 120° relative to the short leg 156 as required or desired. Additionally, the L-shaped members 148, 150 are substantially parallel to one another. In other examples, the L-shaped members 148, 150 may be angled to one another such that the short legs 156 form a V-shape and the long legs 154 are parallel to one another.

To couple the pack 106 to the frame system 108, the long legs 154 are inserted through the respective elongated channel 144, 146 so that the rear wall 112 is adjacent and secured to the long legs 154. The pack 106 can slide along the long legs 154 so that the base 110 can be positioned adjacent the short legs 156. In some examples, the base 110 may include additional straps (not shown) so as to secure the base 110 to the short legs 156. The free ends the long legs 154 can extend above the lid 120 of the pack 106. Additionally, the free ends of the short legs 156 can extend past the front wall 114 of the pack 106. This extension of the legs 154, 156 enables the frame system 108 to be used for further attachment members so that even more tools and/or equipment can be externally mounted to the backpack 100. The frame system 108 is attached to the exterior 134 of the pack 106 so that it can easily be removed as required or desired, and can be formed from substantially rigid tubular members. In some examples, the frame system 108 may be manufactured from substantially rigid metals (e.g., aluminum, titanium), plastics, carbon fiber, or the like. In other examples, the frame system 108 may be formed from members with a flat cross-section, oval cross-section, square cross-section, etc. as required or desired.

In the example, the shoulder straps 126, 128 are positioned between the L-shaped members 148, 150, when the pack 106 is coupled to the frame system 108. This allows the L-shaped members 148, 150 to be accessible and used as attachment points while the pack 106 is coupled to the frame system 108. Additionally, the short legs 156 form a substantially flat horizontal plane so that the backpack 100 can easily stand upright when placed on the ground.

The frame system 108 creates a plurality of attachment points so that various tools and equipment can be mounted to the backpack 100 while still enabling use of the features of the pack 106. For example, a firearm 158 can be mounted to the side of one of the L-shaped members 148, 150 and as illustrated in FIG. 1. The frame system 108 also enables for the firearm 158 to be locked to the frame system 108 to prevent removal as required or desired. Also illustrated in FIG. 1, one or more attachment bars 160 can removably couple to the two L-shaped members 148, 150 and extend therebetween. The attachment bar 160 creates more attachment points on the frame system 108. For example, a light mount holder 162 can be mounted to the attachment bar 160 so that a light can be mounted to the backpack 100. The attachment bar 160 slidingly engages with the free ends of either the long legs 154 or the short legs 156, while still enabling the pack 106 to be easily removed as required or desired.

As illustrated in FIG. 1, the first configuration 102 of the backpack 100 has the firearm 158 mounted to the frame system 108 and the attachment bar 160 coupled to the top of the frame system 108 so that additional tools and equipment can be mounted to the backpack 100. Because of the modularity of the components of the backpack 100, the firearm 158 and the attachment bar 160 can easily be removed as required or desired so that other configurations of attachment points can be formed and as illustrated in FIG. 2 and the second configuration 104 of the backpack 100.

Because the frame system 108 (e.g., the L-shaped members 148, 150, the cross bar 152, and attachment bars 160) form a plurality of attachment points that are easily accessible on the exterior of the backpack 100, the frame system 108 can be used for mounting any number of tools and equipment to the backpack 100 without the need to have multiple different backpacks. For example, a shovel head, a camera, or medical devices can be mounted to the frame system 108. Because the frame system 108 stands upright, the frame system 108 can also be used as a shooting platform, with a firearm mount attached to the top of the frame system 108. In still other examples, bicycles, kayaks, camping equipment, rescue equipment, etc. can be mounted to the frame system 108. As such, the backpack 100 is easily adaptable for many different needs and requirements, which increases the versatility of the backpack 100 and eliminates the need to have more than one backpack for different specialized uses.

Figure 3:
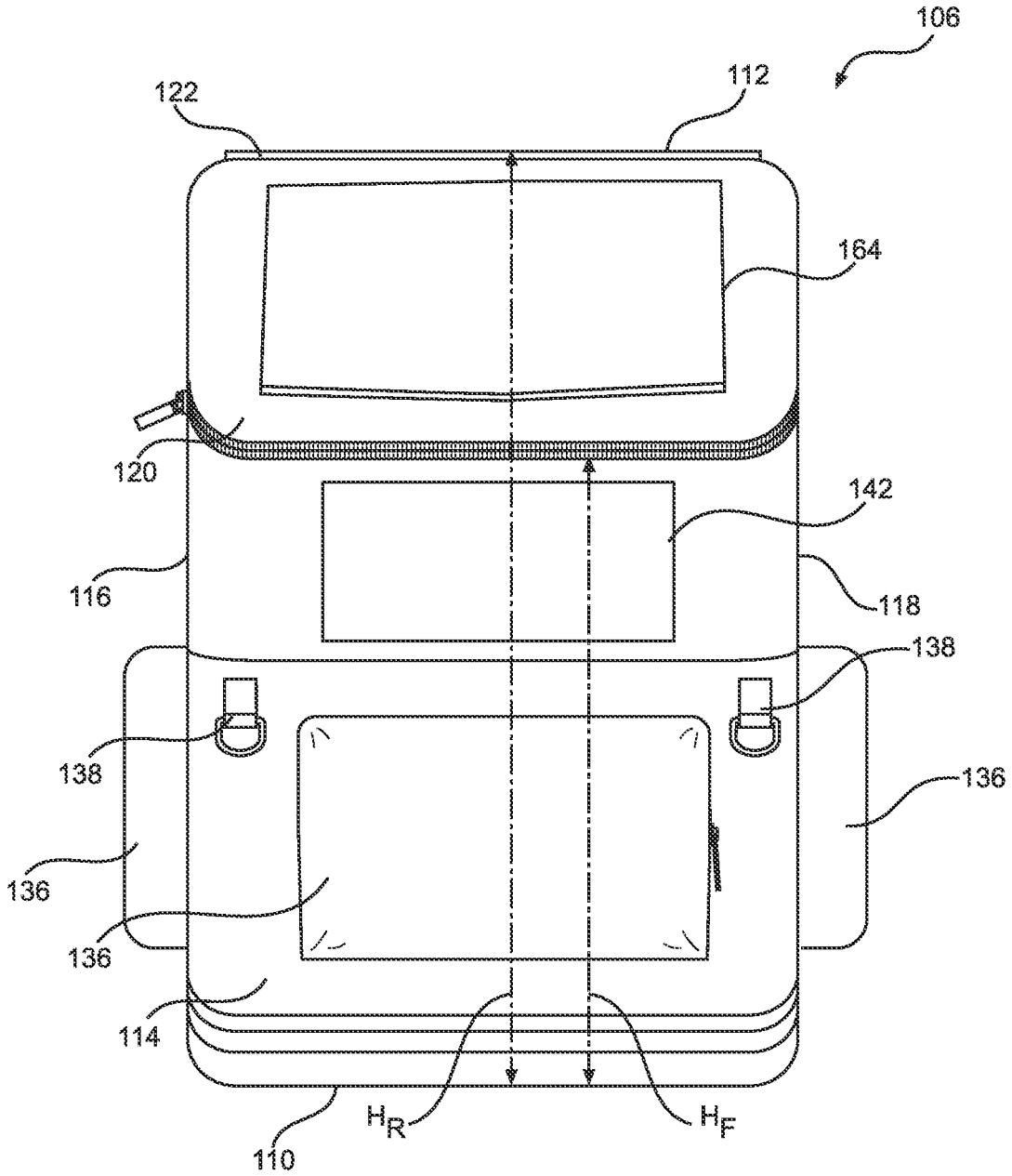
FIG. 3 is a front view of a pack of the modular backpack in a closed configuration.

FIG. 3 is a front view of the pack 106 of the modular backpack 100 (shown in FIGS. 1 and 2) in a closed configuration. Certain components are described above, and thus are not necessarily described further. In the example, the pack 106 is free-standing without the frame system 108 (shown in FIGS. 1 and 2) attached so that the pack 106 can remain upright, structured, and organized whether the base 110 is sitting on a surface or the pack 106 is being carried for increased load weight distribution. The pack 106 can be manufactured from light-weight and semi-flexible materials such as plastic materials, bullet resistant materials, or carbon fiber materials. In some examples, one or more of the base 110, the walls 112-118, and/or the lid 120 may be foam lined for structural support and/or increased comfort. The front wall 114 of the pack 106 has a height $H_F$ that is smaller than a height $H_R$ of the rear wall. As such, the lid 120 is angled so as to increase water resistance of the pack 106 (e.g., water is able to drain off of the lid 120) and so as to accommodate different mounting accessories. In one example, the lid 120 is substantially rigid. In other examples, the lid 120 may include a solar panel 164 disposed on an exterior portion of the lid 120.

Figure 4:
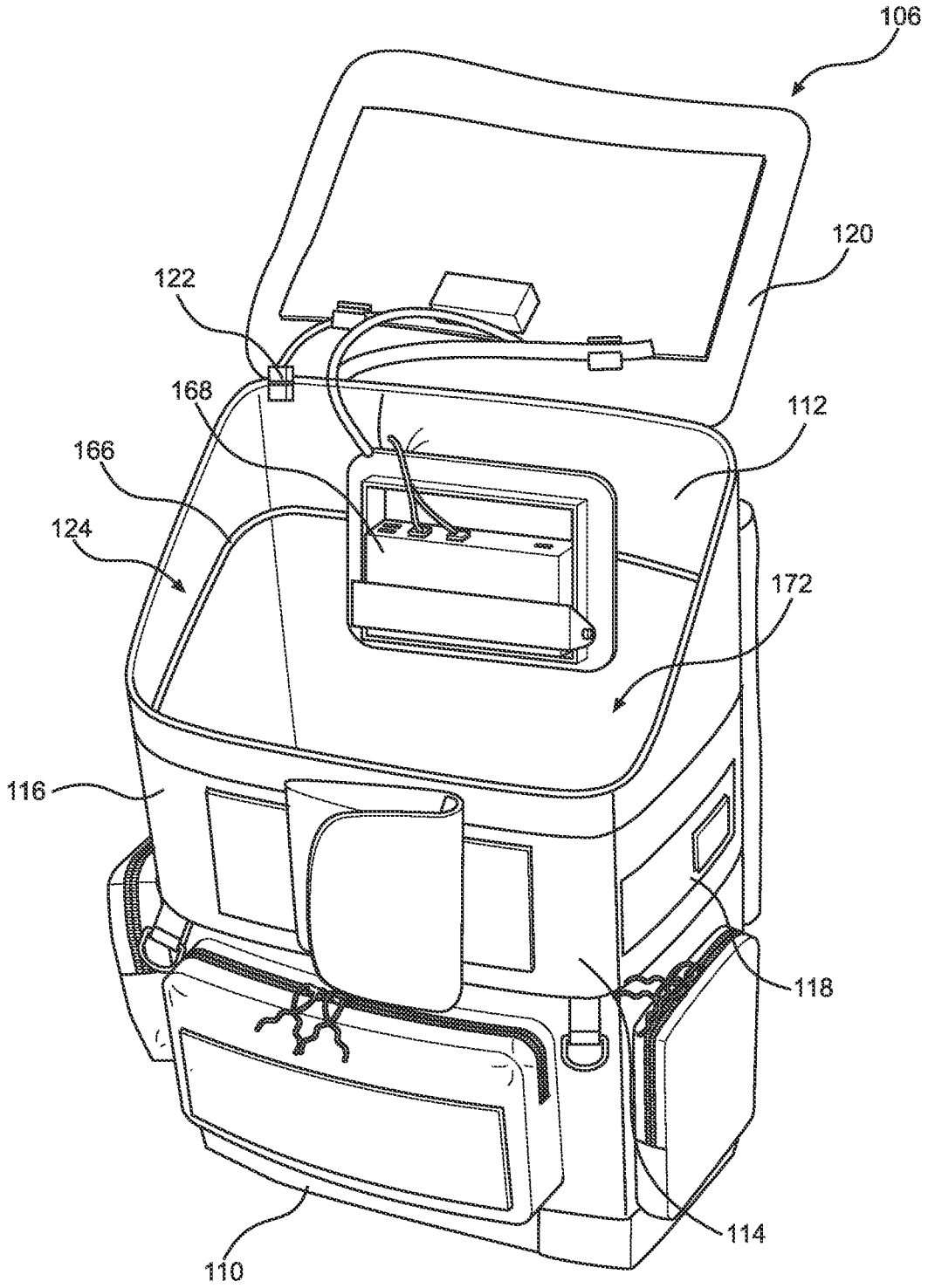
FIG. 4 is a front perspective view of the pack in an open configuration.

The lid 120 extends from the rear wall 112 by the hinge 122 and the lid 120 selectively attaches to the front wall 114 and the side walls 116, 118 so as to close the interior volume 124 (shown in FIG. 4). For example, the lid 120 may close by a zipper. By angling the lid 120 and extending the lid 120 between all four walls 112-118, the lid 120 enables access to the entire interior volume 124 at once, when the lid 120 is opened.

FIG. 4 is a front perspective view of the pack 106 in an open configuration. Certain components are described above, and thus, are not necessarily described further. When the lid 120 is opened, access into the interior volume 124 of the pack 106 is provided. In the example, an insert 166 that corresponds in shape to the base 110 and the walls 112-118 is removably inserted within the interior volume 124. The insert 166 is sized and shaped to support an electronic hub 168 and a power source 170 (shown in FIG. 8), and define a containment space 172 for tools and equipment. For example, the insert 166 may be configured as a medical insert, and carry any number of medical accessories. In another example, the insert 166 may be configured as a firearm insert, and carry any number of firearm accessories. The insert 166 can quickly be changed in and out of the pack 106 for different use-based applications and without unpacking and packing the individual tools and equipment. This type of modularity assists first responders by enabling one pack 106 to be used across multiple applications (e.g., medical, firearm, etc.).

In the example, the insert 166 is an open top container that has a greater rigidity than the pack 106. For example, the insert 166 can be formed out of metals, plastics, foams, ballistic material, and the like. The rigid inserts 166 make it more easy to carry and secure one or more of the following within the insert: the electronic hub 168, the power source 170, tools, tool and machinery systems, tactical gear, firearms, ammunitions, first aid equipment, rescue systems, cameras and recording equipment systems, scanners and bomb sensing systems, metal detecting devices, weapon detection devices, etc. Additionally, the rigid insert 166 can easily be dropped into and taken out of the pack 106. Furthermore, the rigid insert 166 can be used in any other backpack design as required or desired. By using ballistic material for construction, the pack 106 may increase protection from the user. In still other examples, the insert 166 does not need to include any accessories. For example, an empty insert 166 can be used to assist in packing out cadaver bones with the pack 106. The insert 166 can also be constructed out of flexible materials as required or desired.

When the insert 166 is inserted within the interior volume 124, the electronic hub 168 is positioned proximate the lid 120 of the pack 106. The electronic hub 168 can include one or more inputs or outputs so that the insert 166 can power and/or charge electronic accessories. For example, the electronic hub 168 may include USB ports, auxiliary ports, audio ports (e.g., a speaker output), HDMI ports, memory ports, various electrical cord sockets, and the like. As such, electronic accessories including cell phones, laptops, tablets, cameras, recorders, lights, rescue equipment, EMS equipment, pumps, compressors, monitors, dental equipment, sewing machines, electric tools (e.g., saws, drills, and cutters), radio and communication equipment, etc. can easily be used with the pack 106. The specific electronic hub 168 configuration and electronic accessories can be customized to the specific application. In some examples, remote control of the electronic hub 168 may be provided on the pack 106. For example, a switch (not shown) may be located on one of the shoulder straps 126, 128 (shown in FIG. 2). Because first responders rely more and more on electrical devices, an integrated electrical system within the pack 106 increases the adaptability of the backpack across many different fields of use.

Figure 5:
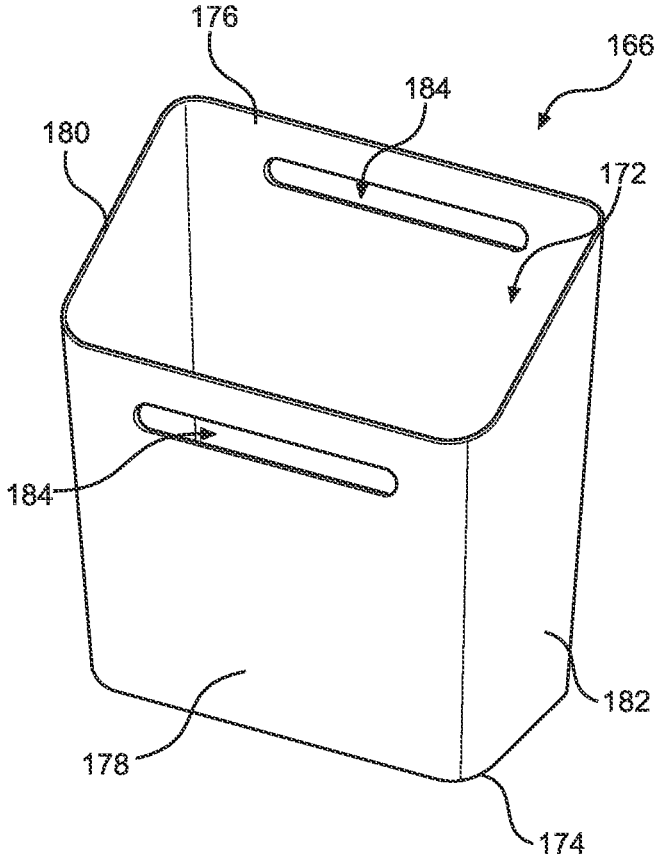
FIG. 5 is a front perspective view of an insert of the modular backpack.

FIG. 5 is a front perspective view of the insert 166 of the modular backpack 100 (shown in FIGS. 1 and 2). The insert 166 is an open top container having an insert base 174 with an insert rear wall 176, an insert front wall 178, and insert left and right side walls 180, 182, all extending therefrom. The insert base 174 and the insert walls 176-182 define the containment space 172 for holding tools and equipment, and the insert 166 is open at top for access into the containment space 172. In the example, the insert 166 has a size and shape that corresponds to the size and shape of the pack 106 (shown in FIGS. 3 and 4). Accordingly, when the insert 166 is placed within the pack, the insert base 174 and insert walls 176-182 are directly adjacent to the corresponding base and walls of the pack. The insert rear wall 176 has a height that is greater than the insert front wall 178 so that the lid of the pack may still close. In other examples, the insert 166 may be smaller than the interior volume of the pack so that there is space between the insert walls 176-182 and the pack walls. In still other examples, the insert 166 may be sized and shaped so that two or more removable inserts can fit within the interior volume of the pack.

An elongated slot 184 is defined proximate the top of at least one of the insert rear wall 176 and the insert front wall 178. The slots 184 are configured to support the electronic hub 168 (shown in FIG. 4) and/or the power source 170 (shown in FIG. 8) on the insert 166. For example, a bracket may be used to secure the electronic hub (as shown in FIG. 4) to the slot 184 of the insert rear wall 176. By locating the electronic hub proximate the lid of the pack, access to the hub within the pack is improved. In other examples, a holder 186 may be used to support the electronic hub and/or power source to the insert 166. The holder 186 is described further below in reference to FIG. 6. Other slots, for example, vertical slots may be included on the insert 166 as required or desired so that various tools and equipment can be supported and/or secured to the insert 166.

It should be appreciated that while the exemplary insert 166 illustrated in FIG. 5 is an open top container. The insert 166 can take on a variety of forms as required or desired. For example, the insert 166 may include a hinged insert lid so that the insert can be fully closed. In another example, the insert 166 may only include the insert base 174 and the insert rear wall 176 so that the insert is substantially L-shaped. In yet another example, the insert 166 may only include the insert base 174 and one or both of the left and right insert side walls 180, 182.

Figure 6:
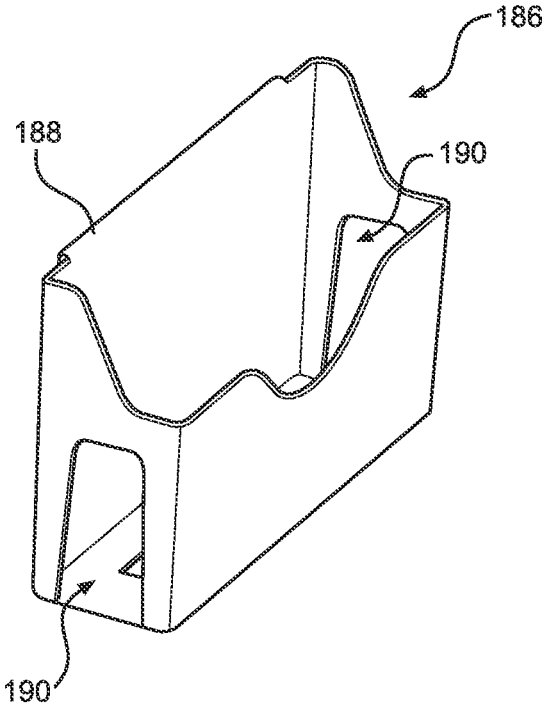
FIG. 6 is a side perspective view of a holder for the insert.

FIG. 6 is a side perspective view of the holder 186 that can be used with the insert 166 (shown in FIG. 5). The holder 186 is a container that can hold the power source 170 (shown in FIG. 8) and that can be selectively coupled to the insert as required or desired. By having the power source removably separate from the insert, the power source can be recharged and replaced separately. In other examples, the holder 186 may hold the electronic hub 168 (shown in FIG. 5) and be used to support the hub on the insert. In the example, the holder 186 includes a hook 188 on the exterior. The hook 188 can be used to couple the holder 186 one of the slots 184 of the insert 166 (shown in FIG. 5). In other examples, any other connection mechanism can be used to secure the holder 186 to any part of the insert and/or pack as required or desired. These connection mechanisms includes screws, glues, magnets, tongue and groove connectors, etc. The holder 186 may also include one or more openings 190 so that power cables (not shown) can extend between the power source and the electronic hub. In other examples, electrical contacts (not shown) may be mounted within the openings 190 so that the holder 186 is a support frame for batteries used as the power source.

Figure 7:
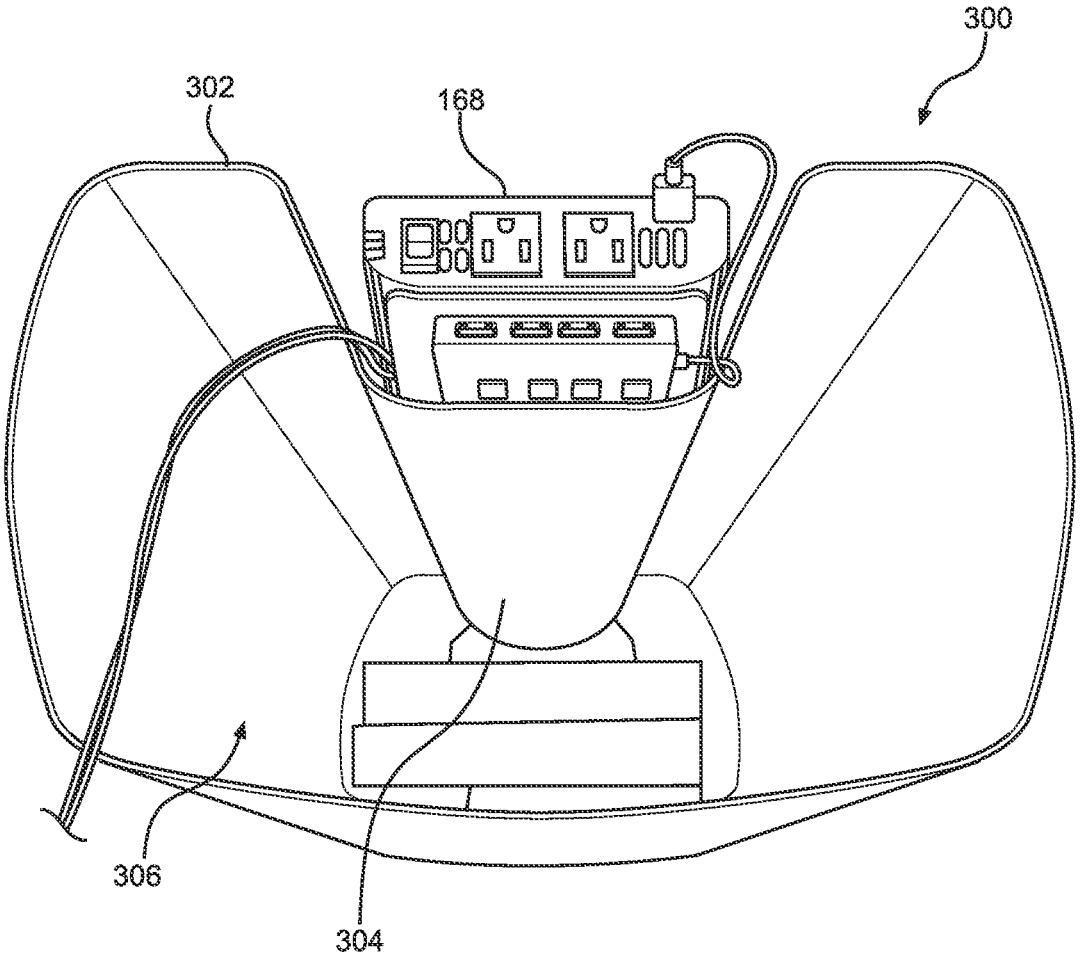
FIG. 7 is a top view of another example of an insert.
Figure 8:
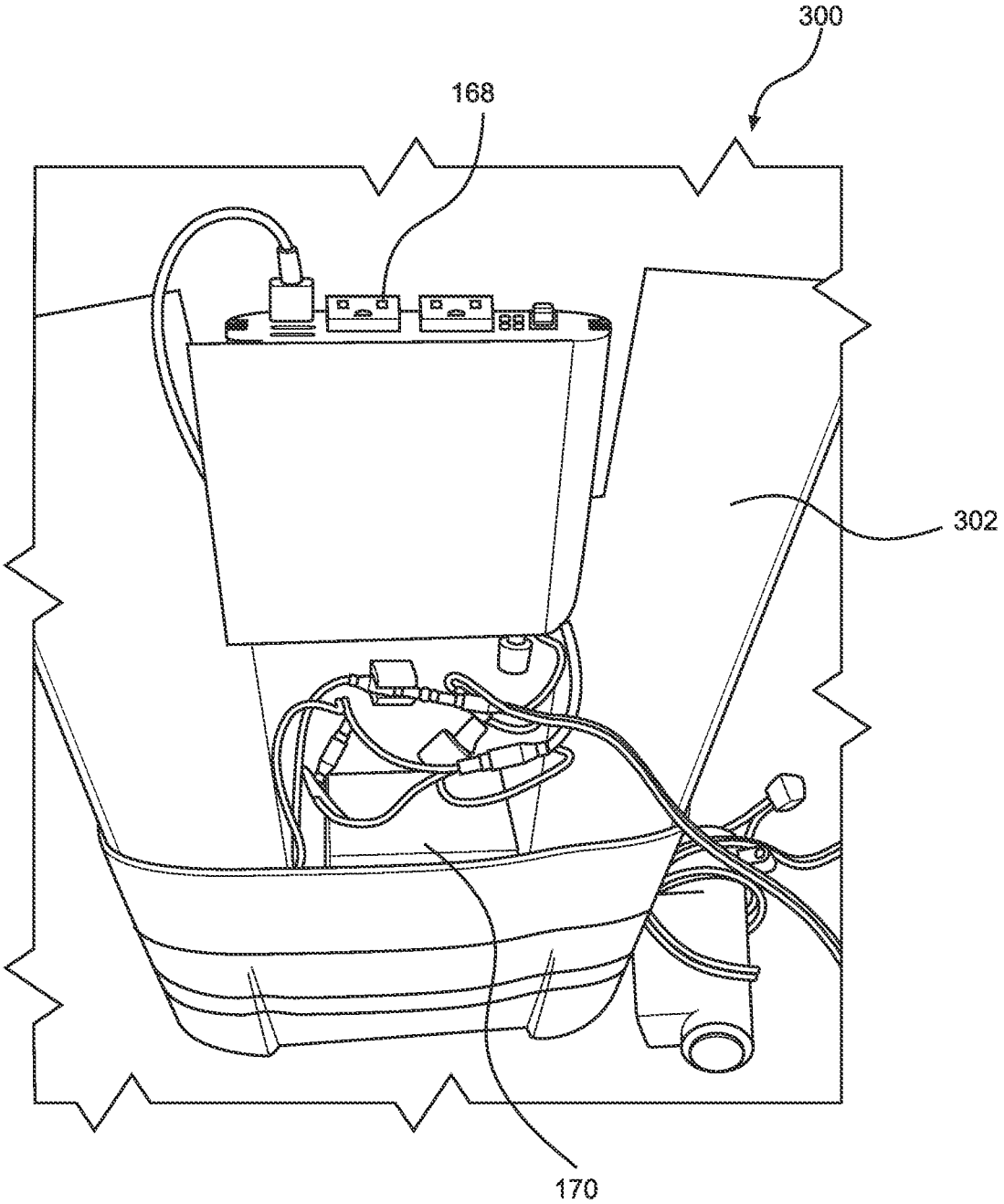
FIG. 8 is a rear view of the insert shown in FIG. 7.

FIG. 7 is a top view of another example of an insert 300. FIG. 8 is a rear view of the insert 300. Referring concurrently to FIGS. 7 and 8, the insert 300 is sized and shaped to be removably inserted within the interior volume 124 of the pack 106 (shown in FIG. 4). Similar to the example described above, the insert 300 is a substantially rigid open top container that supports the electronic hub 168 and the power source 170. In this example, an insert rear wall 302 of the insert 300 has a U-shaped channel 304 such that a pocket is formed on the exterior of the insert rear wall 302. This pocket is sized and shaped to receive the electronic hub 168 and the power source 170 so that a containment space 306 of the insert 300 is free from these electrical components. The electronic hub 168 is coupled to and supported on a top portion of the insert rear wall 302, while the power source 170 is removably coupled to and supported on a bottom portion of the insert rear wall 302 with the electronic hub 168 above.

The power source 170 is configured to run multiple electronics and electronics systems, and can be rechargeable as required or desired. For example, the solar panel 164 (shown in FIG. 3) can be used to recharge the power source 170. In other examples, the solar panel can even be used as the power source itself to run at least a portion of the electronic hub 168. The power source 170 can be a battery, for example, lithium-ion battery, lithium-ion polymer battery, nickel-cadmium battery, etc. The power source 170 can have a charge port on its bottom (not shown) so that the insert 300 can be lifted out of the pack and directly dropped into a charging station between uses. By integrating the electronic hub 168 and power source 170 directly into the backpack, the backpack can be used to assist in lighting, heating, playing music, etc. in outdoor or indoor areas. For example, music or a heater (not shown) can be electrically coupled to the electronic hub 168 for use. In another example, a light bar attachment (not shown) may be electrically coupled to the electronic hub 168 for use. In yet other examples, the light bar attachment may be coupled to the frame system 108 (shown in FIGS. 1 and 2) of the backpack. In still other examples, a light may be integrated into the pack as required or desired.

In another example, the electronic hub 168 may be integrated with the attachment bar 160 (shown in FIG. 1) so that the hub is located on the frame system as required or desired. In this example, the power source 170 may be coupled to or integrated within the frame system.

Figure 9:
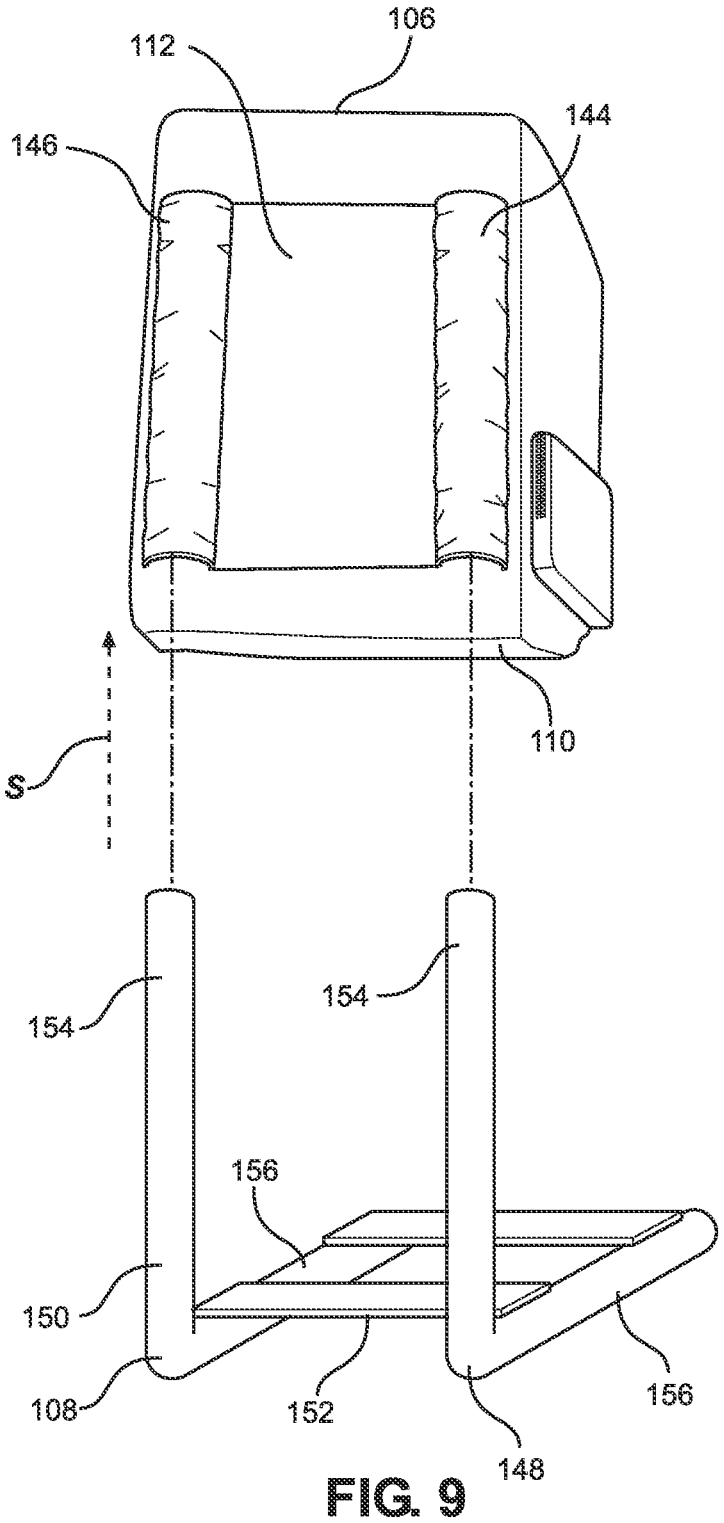
FIG. 9 is a schematic view of the pack and a frame system of the modular backpack.

FIG. 9 is a schematic view of the pack 106 and the frame system 108 of the modular backpack 100 (shown in FIGS. 1 and 2). As described above, the pack 106 can be easily removed and coupled to the frame system 108 as required or desired. While the pack 106 is configured to carry a load within, the frame system 108 enables for any number of additional tools and equipment to be secured to the exterior of the backpack. To couple the pack 106 to the frame system 108, the rear wall 112 of the pack 106 includes two elongated channels 144, 146 that extend vertically and proximate to the left and right sides of the pack 106. The channels 144 can receive the free ends of the long legs 154 of each of the two L-shaped members 148, 150 of the frame system 108. The L-shaped members 148, 150 are coupled together by two cross bars 152. The channels 144, 146 enable the pack 106 to slide S along the long leg 154 until the base 110 of the pack 106 is adjacent to the short legs 156 of the L-shaped members 148, 150. In some examples, the frictional resistance between the channels 144, 146 and the long legs 154 is sufficient to secure the frame system 108 to the pack 106. In other examples, one or more straps (not shown) can be used to secure the base 110 of the pack 106 to the short legs 156. In yet another example, the attachment bar 160 (shown in FIG. 1) may be used to secure the pack 106 to the frame system 108.

Because the shoulder straps 126, 128 and the waist straps 130, 132 (both shown in FIG. 1) extend from the pack 106, the pack 106 can be used with and without the frame system 108. Additionally, the frame system 108 is configured such that it does not interfere with the shoulder straps or the waist straps. In the example, the frame system 108 does not include any shoulder straps or waist straps. Although, a separate harness (not shown) may be attachable to the frame system 108 so that a user can separately carry the frame system 108 without the need of the pack 106.

Figure 10:
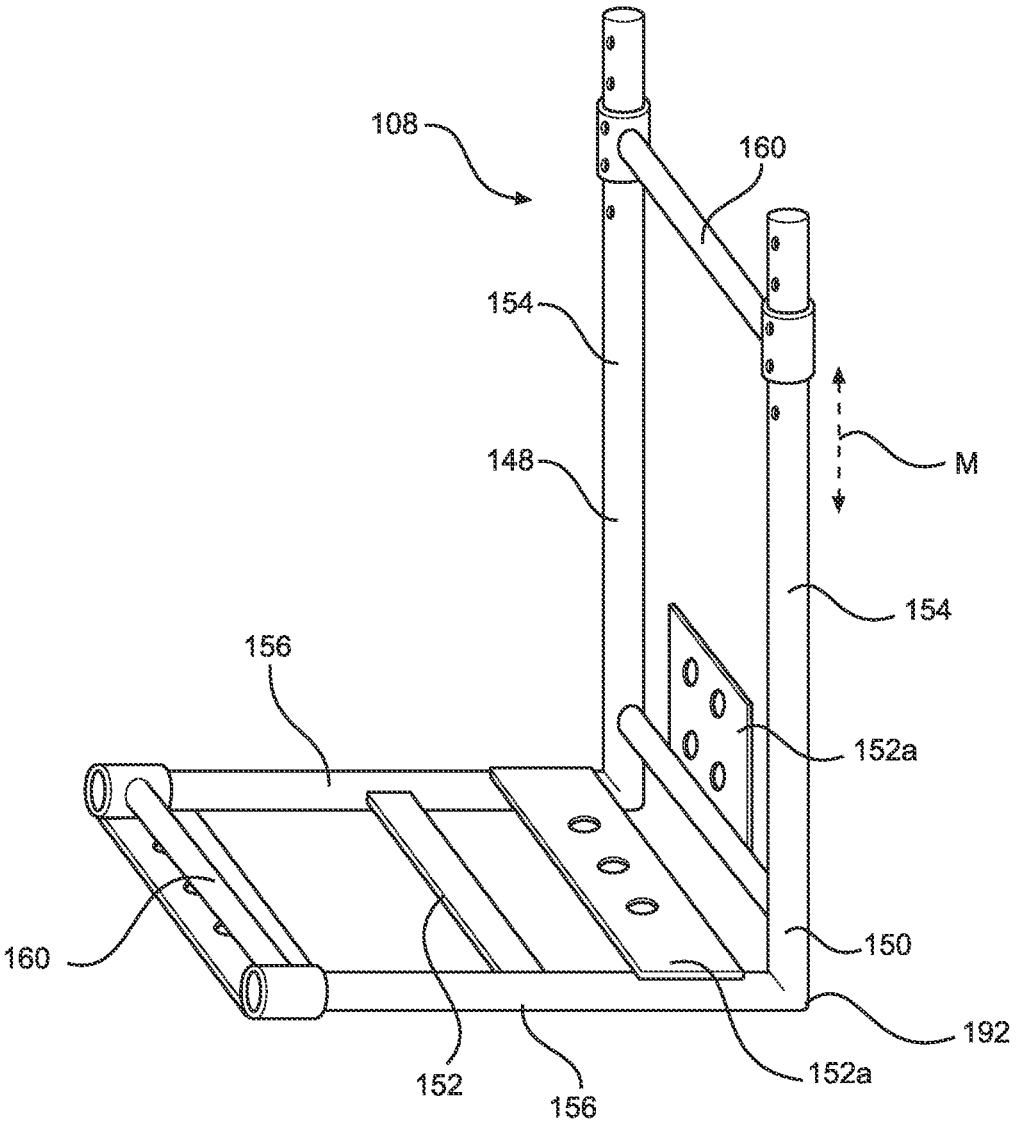
FIG. 10 is a perspective view of the frame system.

FIG. 10 is a perspective view of the frame system 108. The frame system 108 includes the L-shaped members 148, 150 with long legs 154 and short legs 156. The long leg 154 is coupled to the short leg 156 at a heel 192 that in this example is about 90°. One or more cross bars 152 couple the two L-shaped members 148, 150 together at a predetermined spacing. When the L-shaped members 148, 150 and cross bars 152 are coupled together, the frame system 108 forms a chair-like shape so that it can be used with the pack 106 (shown in FIG. 9). In the example, the cross bars 152 are removable so that the frame system 108 can be disassembled. In some examples, when the frame system 108 is disassembled, the components can be reassembled into a second configuration that is different than the chair-like shape. For example, the frame system 108 can be used to form a stretcher-like structure so that it can be used in emergency situations to carry a load between two people. In some examples, one or more of the cross bars 152*a* may be a slotted plate. The slotted plate 152*a* enables extra padding or heater systems to be attached to the frame system 108. In still other examples, the L-shaped members 148, 150 and one or more of the cross bars 152 may be a unitary component.

The frame system 108 also includes one or more attachment bars 160 that can selectively couple to the free ends of the L-shaped members 148, 150 and slide thereon. The attachment bar 160 is substantially I-shaped with two end tubes that slide over the ends of the L-shaped members 148, 150 and a middle member that spans between the end tubes. In the example, the end tubes may secure to the L-shaped members 148, 150 with a locking pin and hole connection so that the attachment bar 160 can move M into a position as required or desired. In other examples, any connection system (e.g., locking clip, cone style lock, threaded) that enables the attachment bar 160 to function as described herein may be used. The attachment bars 160 can be coupled to the frame system 108 after the pack 106 is coupled to the frame system 108 so that additional attachments points are formed and various tools and equipment can be carried by the backpack. The attachment bars 160 also do not cover the free end of the legs 154, 156, so that the ends of the legs 154, 156 can also be used to attach tools and equipment. This attachment point enables the frame system 108 to be used as a sturdy platform base (e.g., resistance to overturning). For example, an umbrella (not shown) can be supported at the end of the long leg 154. In another example, a firearm support mount (not shown) can be supported at the end of the long leg 154 so that the frame system 108 can be used as a shooting platform.

The frame system 108 and its components (e.g., L-shaped members 148, 150, the cross bars 152, and the attachment bars 160) are configured to create a plurality of attachment points on the backpack so that various tools and equipment can be mounted to the backpack at any location that is as required or desired. This includes any number of upper attachment points and lower attachment points on the frame system 108. For example, tools such as shovels can be mounted to the frame system 108, and equipment such as cameras, lights, medical devices, LCD screens, bikes, kayaks, camping equipment, rescue equipment, wench systems, pulley systems, etc. can be mounted to the frame system 108 for hands free carry, and that can be powered by the electronic hub 168 (shown in FIG. 4). Additionally, a harness (not shown) can be coupled to the frame system 108 (e.g., via a plurality of attachment points) so that the frame system 108 can be used to as a load attachment point (e.g., lifting and extracting a person attached to the frame system 108 via an airlift). Moreover, the frame system 108 itself can be used as a chair so that wheels (not shown) can be attached and a mobile system is created. In other examples, the frame system 108 can be attached to trees or other structures for a support above ground. In still other examples, the frame system 108 can be used as an anchor in emergency situations. In yet another example, the short legs 156 can fold relative to the long legs 154 (e.g., about a pivot point at the heel 182) so that the frame system 108 can fold as required or desired.

Figure 11:
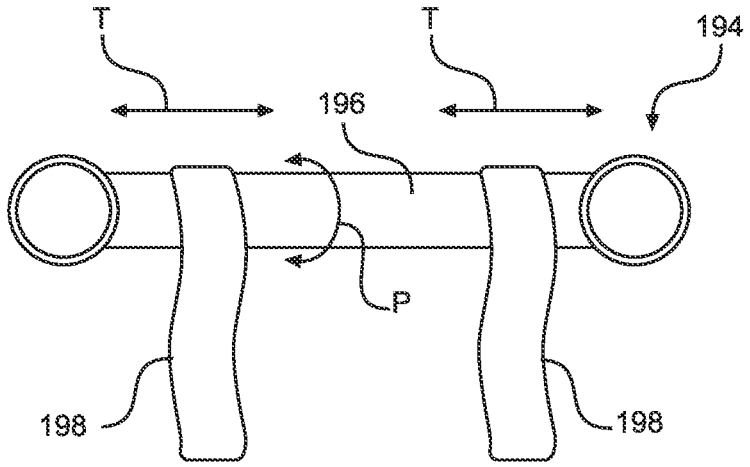
FIG. 11 is a top view of another example of an attachment bar for the frame system.

FIG. 11 is a top view of another example of an attachment bar 194 for the frame system 108 (shown in FIG. 10). In this example, a middle member 196 of the attachment bar 194 includes a pair of shoulder load adapters 198. When the attachment bar 194 is coupled to the long legs 154 (shown in FIG. 10), the shoulder load adapters 198 can extend in a direction away from the pack 106 (shown in FIG. 9) and be positioned on top of the user's shoulders to assist with transferring and distributing the load mounted to the frame system 108 and increase the performance and comfort of the backpack. One or both of the shoulder load adapters 198 can be translatable T along the attachment bar 194 and/or pivotable P relative to the attachment bar 194 so as to increase position adjustability for the user.

Figure 12:
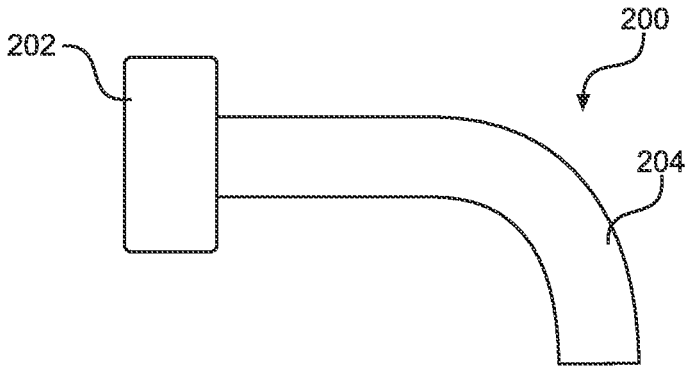
FIG. 12 is a side view of another example of an attachment bar for the frame system.

FIG. 12 is a side view of another example of an attachment bar 200 for the frame system 108 (shown in FIG. 10). In this example, one or both of an end tube 202 of the attachment bar 200 can include a curved load bar 204. With the addition of the curved load bar 204, even more attachment points are formed on the frame system. The attachment bar 200 can be coupled to the long legs of the L-shaped members so that the curved load bar 204 extends in a direction away from the pack 106 (shown in FIG. 9) and a light or a camera can be mounted over the shoulder of the user. The attachment bar 200 can also be coupled to the long legs of the L-shaped members so that the curved load bar 204 extends over the lid of the pack so as to create another substantially horizontal attachment platform. The attachment bar 200 can further be coupled to the short legs of the L-shaped members so that the curved load bar 204 extends over the front of the pack so as to create another substantially vertical attachment platform. In other examples, the curved load bar 204 may extend from the middle member of the attachment bar 200.

Figure 13:
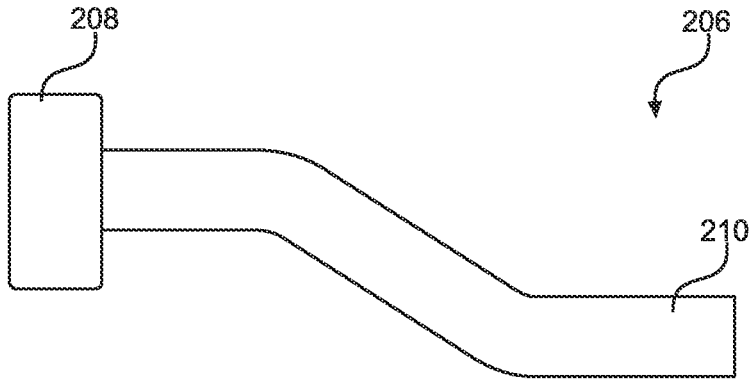
FIG. 13 is a side view of another example of an attachment bar for the frame system.

FIG. 13 is a side view of another example of an attachment bar 206 for the frame system 108 (shown in FIG. 10). In this example, one or both of an end tube 208 of the attachment bar 206 can include an angled load bar 210. With the addition of the angled load bar 210, even more attachment points are formed on the frame system. The attachment bar 206 can be coupled to the long legs of the L-shaped members so that the angled load bar 210 extends over the lid of the pack 106 (shown in FIG. 9) so as to create another substantially horizontal attachment platform. The attachment bar 206 can further be coupled to the short legs of the L-shaped members so that the angled load bar 210 extends over the front of the pack so as to create another substantially vertical attachment platform. In other examples, the angled load bar 210 may extend from the middle member of the attachment bar 206.

Figure 14:
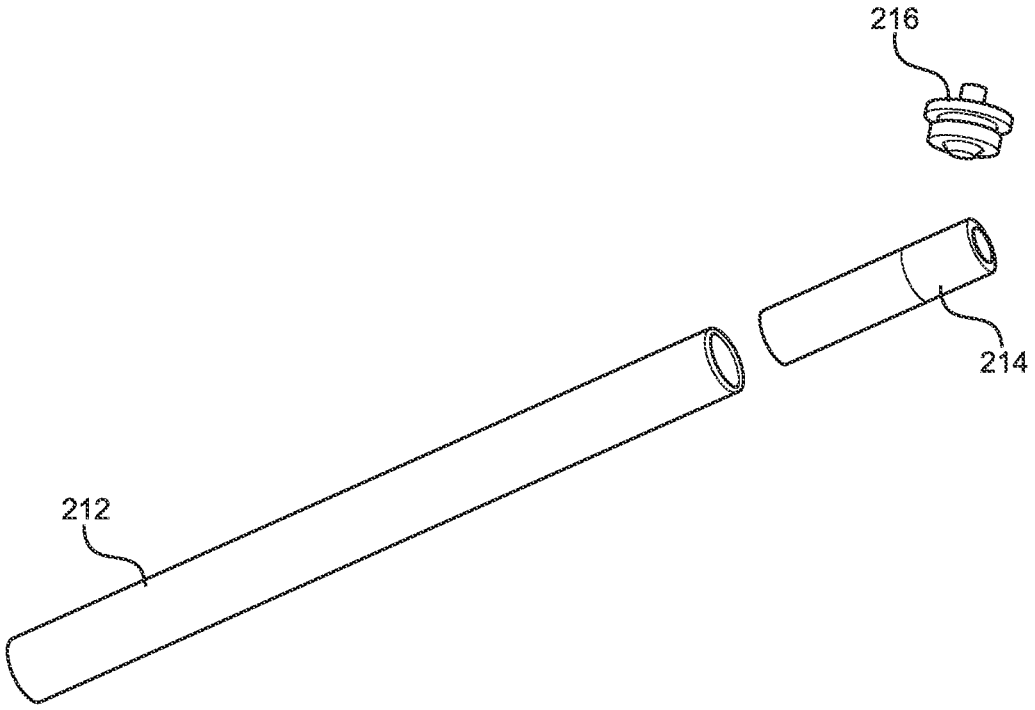
FIG. 14 is a perspective view of a member of the frame system.

FIG. 14 is a perspective view of a member 212 of the frame system 108 (shown in FIG. 10). As described above, one or more of the components of the frame system may be formed from tubular shaped members. The tubular shape increases the ability to attach various tools and equipment to the frame system as required or desired. Additionally, in some examples, the tubular shape can be used to store one or more components within the frame system for efficiency. For example, the member 212 is configured to store one or more batteries 214 within. For example, a plurality of cylindrical shaped batteries 214 in series. The member 212 also has a removable cap 216 so that access to the batteries 214 is provided. In some examples, the batteries 214 may form at least a portion of the power source 170 (shown in FIG. 8) of the backpack so that the power source is disposed within at least a portion of the frame system. As such, the member 212 can include electrical connections that couple to the electronic hub. In other examples, the batteries 214 may be a secondary power source for the tools and equipment carried by the backpack. In still another example, the batteries 214 may be rechargeable and electrically connected to the solar panel 164 (shown in FIG. 3) on the pack.

Additionally or alternatively, the tubular member 212 may be part of a water tank so that water or any other fluid can be stored within the frame system. The member 212 may also store matches, medicines, fishing supplies, food, flares, first aid kit, etc. as required or desired.

Figure 15:
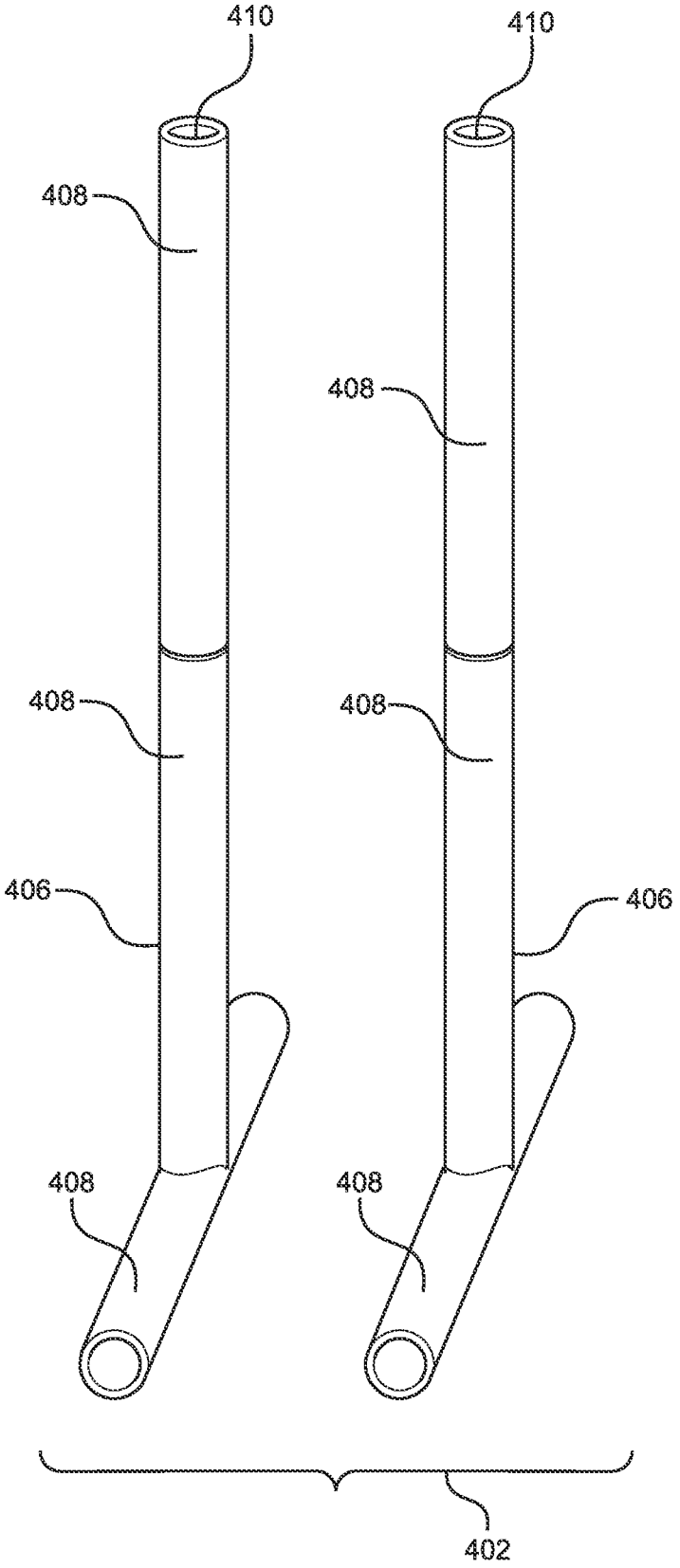
FIG. 15 is a perspective view of another frame system in a first configuration.
Figure 16:
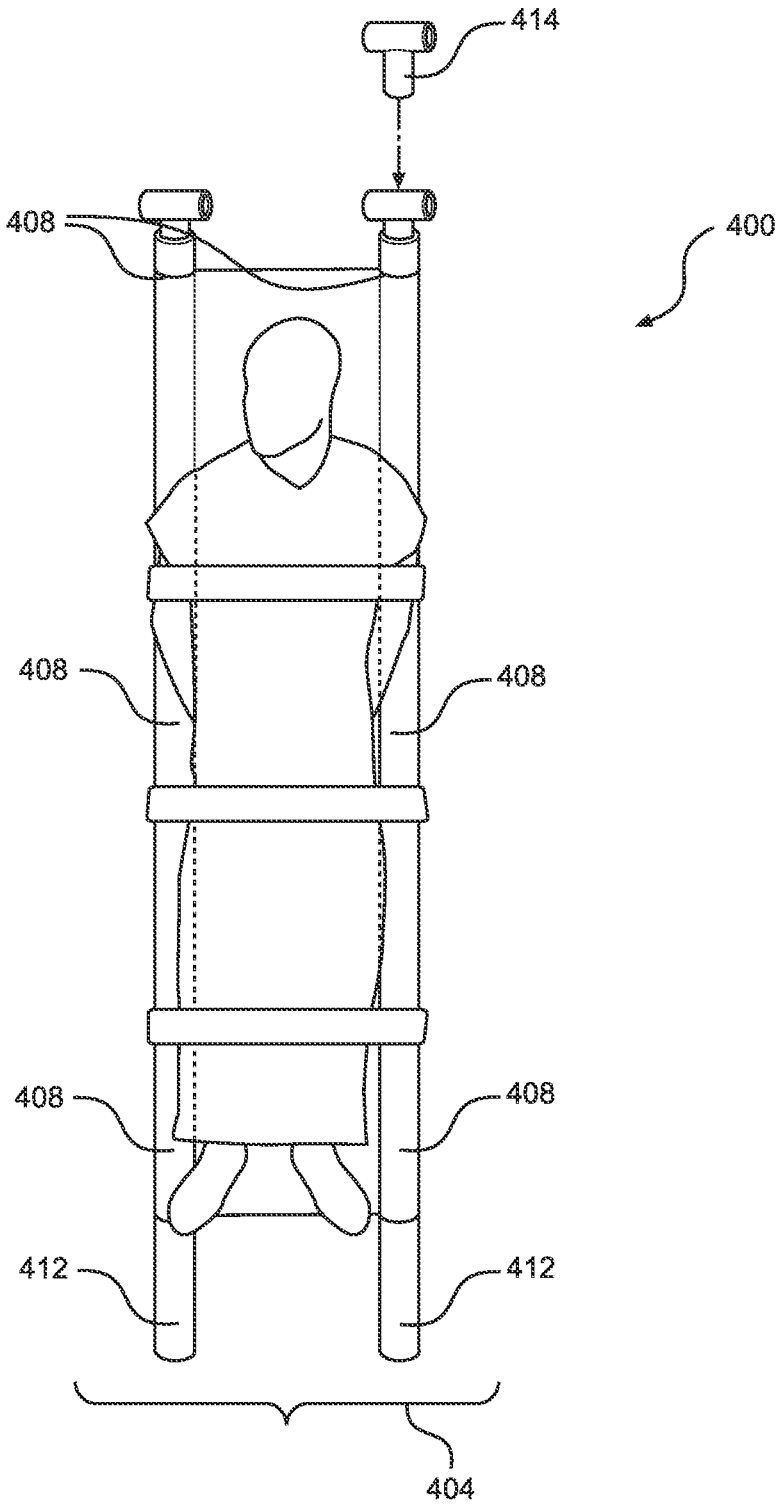
FIG. 16 is a perspective view of the frame system shown in FIG. 15 in a different second configuration.

FIG. 15 is a perspective view of another frame system 400 in a first configuration 402. FIG. 16 is a perspective view of the frame system 400 in a different second configuration 404. Referring concurrently to FIGS. 15 and 16, in this example, the frame system 400 has its L-shaped members 406 formed from a plurality of sections 408. The cross bars are not shown for clarity, but have similar functionality as required or desired. Each section 408 can be selectively attached to one another so that the frame system 400 can change configurations. For example, in the first configuration 402, the frame system 400 is in a chair-like shape as described above for coupling to the pack 106 (shown in FIGS. 3 and 4). A long leg 410 can have more than one section 408 (e.g., two as illustrated in FIG. 15). The sections 408 may threadingly couple together to form this configuration 402.

Because the sections 408 can selectively attach together (e.g., via threads), the frame system 400 can change configurations as required or desired. For example, the sections 408 may be decoupled from the first configuration 402 and be reassembled in a stretcher-like configuration 404. In the second configuration 404, each L-shaped member 406 may be reassembled in a straight line 412 and the cross bars can extend between. This forms a rectangular platform so that a person can be carried as illustrated in FIG. 16. In some examples, handles 414 may also be used.

It is to be understood that this disclosure is not limited to the particular structures, process steps, or materials disclosed herein, but is extended to equivalents thereof as would be recognized by those ordinarily skilled in the relevant arts. It should also be understood that terminology employed herein is used for the purpose of describing particular examples only and is not intended to be limiting. It must be noted that, as used in this specification, the singular forms "a," "an," and "the" include plural referents unless the context clearly dictates otherwise.

This disclosure describes some examples of the present technology with reference to the accompanying drawings, in which only some of the possible examples were shown. Other aspects can, however, be embodied in many different forms and should not be construed as limited to the examples set forth herein. In this regard, any number of the features of the different examples described herein may be combined into one single example and alternate examples having fewer than or more than all of the features herein described are possible.

It is therefore desired to be secured in the appended claims all such modifications as fall within the spirit and scope of the technology. Accordingly, what is desired to be secured by Letters Patent is the technology as defined and differentiated in the following claims, and all equivalents.

What is claimed is:

1. A backpack comprising:

a frame system comprising:

two substantially L-shaped members, each L-shaped member having a short leg and a long leg;

one or more cross bars that extend between the two L-shaped members; and at least one attachment bar that removably couples to either end of the two L-shaped members and extends therebetween, wherein the at least one attachment bar comprises receiving members disposed at each end and configured to receive therein a respective L-shaped member of the two L-shaped members and allow the at least one attachment bar to be slidably adjustable along the two L-shaped members;

a pack comprising:

a base;

a rear wall, a front wall, and two side walls, wherein the walls extend from the base;

a closable lid, wherein an interior volume is defined by the base, the walls, and the lid;

at least one shoulder strap disposed at the rear wall; and a pair of elongated channels spaced apart on the rear wall, the pair of elongated channels extending in a direction from the base towards the lid, wherein the pack removably couples to the frame system by inserting at least a portion of each of the long legs into the respective elongated channel, and wherein when the pack is coupled to the frame, the base of the pack is supported on the two short legs of the two L-shaped members, the frame system is on an exterior of the pack, and the at least one attachment bar can removably couple to either end of the two L-shaped members;

an insert sized and shaped to be removably inserted within the interior volume of the pack, wherein the insert has a rear wall that is positioned adjacent the rear wall of the pack when disposed within the interior volume of the pack, the rear wall of the insert forming a channel such that an exterior pocket is formed on the rear wall of the insert;

an electronic hub coupled to the insert and disposed at a top of the exterior pocket; and a power source coupled to the insert and disposed at a bottom of the exterior pocket, wherein the electronic hub and the power source are coupled to an exterior of the insert and are positioned between the rear wall of the pack and the rear wall of the insert when the insert is disposed within the interior volume of the pack.

2. The backpack of claim 1, wherein the pack is freestanding without the use of the insert or the frame system.

3. The backpack of claim 1, wherein the insert is formed from ballistic material.

4. The backpack of claim 1, wherein the one or more cross bars are removably coupled to the two L-shaped members.

5. The backpack of claim 1, wherein the at least one attachment bar further includes at least one angled load bar and/or curved load bar.

6. A modular backpack system comprising:

a pack comprising a base and a rear panel, wherein the rear panel comprises at least one shoulder strap and two elongated channels, wherein the pack defines an internal volume and the internal volume is closeable with a lid;

a frame system couplable to an exterior of the pack, wherein the frame system comprises two L-shaped members each having a long leg and a short leg and the two L-shaped members are coupled together by one or more cross bars extending therebetween, wherein the pack couples to the frame system by sliding the long leg of each L-shaped member through a respective elongated channel so that the rear panel is adjacent to the long legs of the frame system and the base is adjacent to the short legs of the frame system;

at least one removable attachment bar that removably couples to the two L-shaped members and extends therebetween, the at least one removable attachment bar comprises receiving members disposed at each end and configured to receive therein a respective L-shaped member of the two L-shaped members and allow the at least one removable attachment bar to be slidably adjustable along the two L-shaped members, wherein the at least one removable attachment bar is configured to support external equipment;

an insert removably insertable within the internal volume of the pack, wherein the insert comprises an open top container having a rear wall that is positioned adjacent the rear panel of the pack when disposed within the internal volume of the pack, the rear wall of the insert forming a channel such that an exterior pocket is formed on the rear wall of the insert; and an electronics system comprising an electronic hub coupled to the insert and disposed at a top of the exterior pocket, and a power source coupled to the insert and disposed at a bottom of the exterior pocket, wherein the electronic hub and the power source are coupled to an exterior of the insert and are positioned between the rear panel of the pack and the rear wall of the insert when the insert is disposed within the internal volume of the pack.

7. The modular backpack system of claim 6, wherein the insert has a greater rigidity than the pack.

8. The modular backpack system of claim 6, wherein the frame system comprises substantially tubular members, and wherein at least one of the tubular members are configured to store one or more batteries therein.

9. The modular backpack system of claim 6, wherein the one or more cross bars comprise a slotted plate.

10. The modular backpack system of claim 6, wherein the electronic hub is configured for powering external electronic components.

11. The modular backpack system of claim 6, wherein the electronic hub is proximate the lid of the pack, when the insert is inserted within the internal volume of the pack.

12. The modular backpack system of claim 6, wherein the electronic system further comprises a solar panel disposed on an exterior portion of the lid.

13. The modular backpack system of claim 6, wherein the frame system is configurable between a first configuration and a different second configuration, wherein the first configuration is a chair-like shape and the second configuration is a stretcher-like shape.

14. A backpack comprising:

a freestanding pack comprising:

a base;

a rear wall, a front wall, and two side walls, wherein the walls extend from the base;

a closable lid that is hinged at the rear wall and selectively couples to each of the other walls, wherein the rear wall has a greater height than the front wall, and wherein an interior volume is defined by the base, the walls, and the lid;

two shoulder straps disposed at the rear wall; and two elongated channels spaced apart on the rear wall and extending in a vertical direction; and a rigid external frame system comprising:

two substantially L-shaped members spaced apart from one another by one or more removable cross bars, each L-shaped member having a long leg and a short leg, wherein when the pack is removably coupled to the frame system, the long legs are received within the elongated channels so that the rear wall is adjacent to the long legs, the base is supported on the short legs, and the long legs and the short legs extend out past an exterior of the pack;

at least one attachment bar that slidably engages the long legs or the short legs and extends therebetween, wherein the at least one attachment bar comprises receiving members disposed at each end and configured to receive therein a respective L-shaped member of the two L-shaped members and allow the at least one attachment bar to be slidably adjustable along the two L-shaped members;

an insert sized and shaped to be removably inserted within the interior volume of the pack, wherein the insert has a rear wall that is positioned adjacent the rear wall of the pack when disposed within the interior volume of the pack, the rear wall of the insert forming a channel such that an exterior pocket is formed on the rear wall of the insert;

an electronic hub coupled to the insert and disposed at a top of the exterior pocket; and a power source coupled to the insert and disposed at a bottom of the exterior pocket, wherein the electronic hub and the power source are coupled to an exterior of the insert and are positioned between the rear wall of the pack and the rear wall of the insert when the insert is disposed within the interior volume of the pack.

* * * * *